United States Patent [19]

Asai

[11] Patent Number: 4,652,852

[45] Date of Patent: Mar. 24, 1987

[54] DEVICE FOR HOLDING HELICALLY WOUND WIRE RESISTOR OF A WIRE-WOUND TYPE POTENTIOMETER

[75] Inventor: Nobuyoshi Asai, Tokyo, Japan

[73] Assignee: Copal Company Limited, Tokyo, Japan

[21] Appl. No.: 665,660

[22] Filed: Oct. 26, 1984

[30] Foreign Application Priority Data

Oct. 28, 1983 [JP] Japan ..... 58-167250

[51] Int. Cl.[4] ..... H01C 1/02

[52] U.S. Cl. ..... 338/268; 338/269; 219/550

[58] Field of Search ..... 338/267, 268, 269, 275, 338/334; 219/544, 546, 550

[56] References Cited

U.S. PATENT DOCUMENTS 1,119,336 12/1914 Ball ..... 338/268
3,882,297 5/1975 Avalon ..... 338/267 X
4,135,179 1/1979 Snyder ..... 338/268 X
4,510,377 4/1985 Merritt et al. ..... 219/550

FOREIGN PATENT DOCUMENTS 449632 7/1936 United Kingdom ..... 219/550

*Primary Examiner*—E. A. Goldberg
*Assistant Examiner*—M. M. Lateef
*Attorney, Agent, or Firm*—Eric P. Schellin

[57] ABSTRACT

Device for holding a helically wound wire resistor of a potentiometer in a helical groove comprising, an outer cylindrical member having an inwardly projecting ridge extending over the length thereof and a projecting claw, and an inner cylindrical member of an elastic nature having an outer surface engagable with the inner surface of the outer member, wherein the inner member has a cut out portion extending over the length thereof to receive the ridge from the outer member, and a recess in the outer surface to receive the claw of the outer member.

1 Claim, 8 Drawing Figures

DEVICE FOR HOLDING HELICALLY WOUND WIRE RESISTOR OF A WIRE-WOUND TYPE POTENTIOMETER

BACKGROUND OF THE INVENTION

The present invention relates to a device for holding a helically wound wire resistor of a wire-wound type potentiometer.

A prior art device for holding such a helically wound wire resistor in a wire-wound type potentiometer has been produced by injection molding as a cylindrical body made of a resin, the inner surface of which is formed with a helical groove adapted to receive and hold therein the helical resistor.

In producing such a cylindrical body by injection molding, however, the cylindrical body must be rotated about its longitudinal axis along the helical groove formed in the inner surface thereof when the same is to be removed from the metallic mold after the injection molding thereby resulting in a complicated construction of the mold while a long time is required for removing the completed cylindrical body from the mold after the injection molding. Further, a long time is required for assembling the helical resistor in the cylindrical body, because the resistor must be rotated about its longitudinal axis along the helical groove of the cylindrical body. Thus, the production of the cylindrical body and the assembling thereof with the helical resistor require very troublesome operations and a high cost.

SUMMARY OF THE INVENTION

The present invention aims at avoiding the disadvantages of the prior art device for holding a helically wound wire resistor of a wire-wound type potentiometer as described above.

It is, therefore, the object of the present invention to provide a novel and useful device for holding a helically wound wire resistor of a wire-wound type potentiometer, which avoids the above described disadvantages of the prior art device and which can be easily produced by simple metallic molds at a low cost while the time required for assembling the same with the helical resistor is greatly facilitated to enhance the production efficiency.

The above object is achieved in accordance with the characteristic feature of the present invention by providing a device for holding a helically wound wire resistor of a wire-wound type potentiometer in a helical groove formed in the inner surface of a cylindrical body of the device, characterized in that the cylindrical body comprises an outer cylindrical member having a cylindrical inner surface with a longitudinal inwardly projecting ridge extending over the entire length thereof, the inner surface being provided at a position intermediate the length thereof with a projecting arresting claw as well as with at least a stopper projection projecting inwardly from the inner surface at one end of the outer member, and an inner member of an elastic nature formed by injection molding and having an outer cylindrical surface engageable with the inner surface of the outer member and an inner surface formed with the helical groove, the inner member having a longitudinal cut out portion extending over the entire length thereof so as to receive the ridge therein, the inner member being formed with an arresting recess in the outer surface thereof which is adapted to receive and arrest the arresting claw of the outer member when the inner member is inserted into the outer member from the opposite end until the forward end of the inner member is arrested by the stopper projection, portion of the inner member contacting with the arresting claw when the inner member is moved in the outer member being permitted to be deformed elastically by the arresting claw to allow the latter to be received in the recess when the forward end is arrested by the stopper projection thereby preventing the inner member from moving in both the opposite two directions relative to the outer-member by virtue of the provision of the stopper projection and the arresting claw.

In order to permit the forward end of the inner member to ride on the arresting claw without hindrance when the inner member is moved in the outer member, the arresting claw is preferably formed with a guide surface sloping to merge with the inner surface of the outer member toward the end of the outer member from which the inner member is inserted in the outer member, i.e. the end opposite to that at which the stopper projection is provided.

Alternatively, a sloping guiding recess may be provided in the outer surface of the inner member at the forward end thereof so that the arresting claw is gradually received in the guiding recess to allow the inner member to be further moved riding over the arresting claw until the latter is received in the arresting recess.

With the device of the present invention as described above, additional advantage is obtained that the parting of the inner member from the mold during the injection molding as well as the positioning of the helical resistor in the inner member is greatly facilitated by virtue of the capability of elastic deformation of the inner member.

The arresting claw of the outer member may be positioned at any angular position offset from the angular position of the ridge, but it is preferable to position the arresting claw at a position diametrically opposite to the position of the ridge. The arresting recess of the inner member must be angularly positioned correspondingly to that of the arresting claw.

BRIEF DESCRIPTION OF THE DRAWINGS

Now preferred embodiment of the device of the present invention will be described below with reference to the accompanying drawings illustrating the preferred embodiment of the present invention as well as a prior art device for the purpose of comparison.

DETAILED DESCRIPTION OF THE PREFERRED EMBODIMENT

Figure 7:
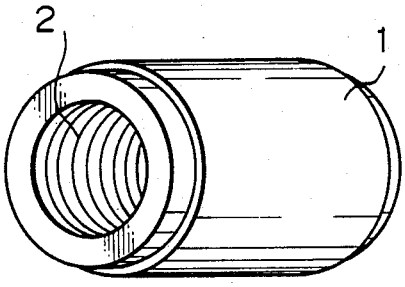
Fig. 7 PRIOR ART
FIG. 7 is a perspective view showing the prior art device for holding a helically wound wire resistor of a potentiometer.
Figure 8:
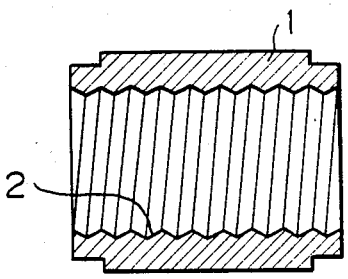
Fig. 8 PRIOR ART
FIG. 8 is a longitudinal sectional view of FIG. 7.

Prior to the description of the present invention, a prior art device for holding a helically wound wire resistor of a potentiometer will be described hereinbelow with reference to FIGS. 7 and 8. The device 1 shown in FIGS. 7 and 8 comprises a cylindrical body 1 made of a resin by injection molding. A helical groove 2 for receiving and holding a helically wound wire resistor (not shown) is formed in the inner surface of the cylindrical body 1. In making such a body 1 by the injection molding, the completed body 1 must be removed from the core of the metallic mold formed with the helical thread-like shape for forming the helical groove of the body 1 by rotating the body 1 about its longitudinal axis along the helical groove of the body 1, which renders the construction of the mold to be complicated while a long time is required for removing the body 1 from the mold.

The present invention avoids the above disadvantages.

Figure 1:
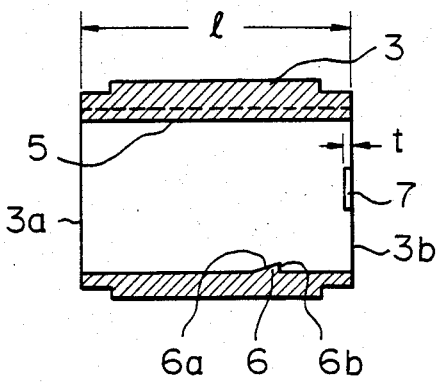
FIG. 1 is a longitudinal secrional view showing the outer member of the device of the present invention.
Figure 2:
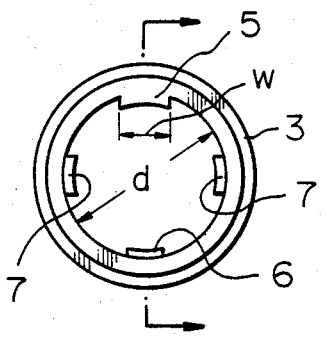
FIG. 2 is an end view of FIG. 1.
Figure 3:
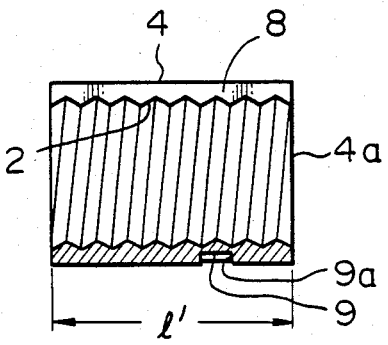
FIG. 3 is a longitudinal sectional view showing the inner member of the device of the present invention.
Figure 4:
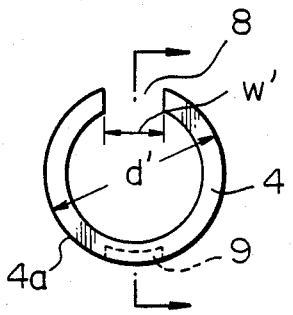
FIG. 4 is an end view of FIG. 3.

The device of the present invention comprises an outer cylindrical member 3 made of a material such as resin by injection molding as shown in FIGS. 1 and 2 and an inner cylindrical member 4 made of an elastic resin by the injection molding as shown in FIGS. 3 and 4, which is adapted to be inserted in the outer member 3 and arrested in position and prevented from moving in both the opposite two directions from the arrested position by means characterized by the present invention as described below.

The outer member 3 is formed in the cylindrical shape by the injection molding as shown in FIGS. 1 and 2, and its inner surface having the inner diameter d is provided with a longitudinal ridge 5 of a predetermined width w extending over the entire length l thereof, an arresting claw 6 at a position intermediate the length l of the outer member 3 and angularly offset from the ridge 5, preferably diametrically opposite to the ridge 5 and a pair of diametrically opposite stopper projections 7, 7 located at the other end 3*b* of the outer member 3. The arresting claw 6 has a sloping guide surface 6*a* merging with the inner surface of the outer member 3 toward one end 3*a* and an arresting surface 6*b* perpendicular to the longitudinal axis of the outer member 3. The stopper projections 7 are preferably located angularly perpendicular to the line passing through the ridge 5 and the longitudinal axis of the outer member 3 in the plane perpendicular to the axis. The number of the stopper projections 7 may be made one or more than two, if desired.

The inner member 4 is formed of an elastic resin in the cylindrical shape by the injection molding as shown in FIGS. 3 and 4, and has the outer diameter d' corresponding to the inner diameter d of the outer member 3 and is provided with a longitudinal cut out portion of the width w' corresponding to the width w of the ridge 5 extending over the entire length l' of the inner member 4 and an internal helical groove 2 for receiving and holding the helically wound wire wound resistor (not shown) of a potentiometer in its inner surface. The length l' of the inner member 4 is preferably a length corresponding to the length l of the outer member 3 with the thickness t of the stopper projection 7 subtracted therefrom, i.e., $l'=l-t$.

The inner member 4 is further provided with an arresting recess 9 in its outer surface at a position to be described later for receiving and arresting the arresting claw 6 of the outer member 3 when the inner member 4 is inserted in the outer member 3 and arrested in position as described hereinafter.

Since the outer diameter d' of the inner member 4 correspond to the inner diameter d of the outer member 3, the inner member 4 can be inserted in the outer member 3 through the end 3*a* thereof with the ridge 5 of the outer member 3 snugly received in the cut out portion 8 of the inner member 4 and the portion of the inner member 4 contacting with the arresting claw 6 deformed to allow the inner member 5 to continue to move and become arrested in position with its forward end 4*a* abutting against the stopper projections 7, 7. The position of the arresting recess 9 is determined so that the arresting claw 6 of the outer member 3 is snugly received in the arresting recess 9 of the inner member 4 when the inner member 4 is inserted in the outer member 3 and arrested in position by the stopper projections 7, 7.

As described above, since the inner member 4 is provided with a longitudinal cut out portion 8 extending over the entire length thereof, it can be easily deformed so as to be removed from the mold after the injection molding without requiring the rotation of the inner member 4 by virtue of the elastic nature of the material forming the inner member 4 even though an internal helical groove 2 is formed, which otherwise renders the parting of the device from the mold to be extremely troublesome and time consuming. Further, the helical resistor can be extremely easily fitted in the internal helical groove 2 of the inner member 4 of the present invention by virtue of the capability of deformation thereof.

Figure 5:
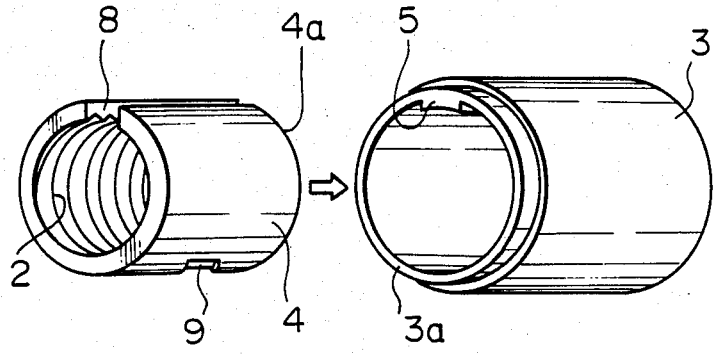
FIG. 5 is an exploded perspective view showing the oute member and the inner member shown in FIGS. 1, 2 and FIGS. 3, 4, respectively, before the inner member is inserted in the outer member.
Figure 6:
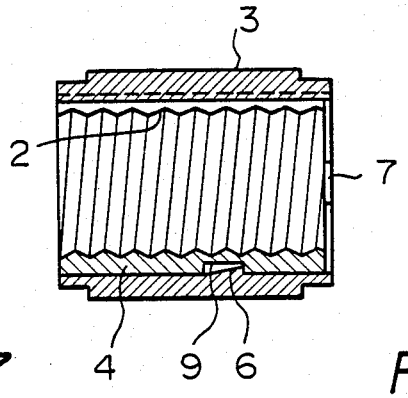
FIG. 6 is a longitudinal sectional view showing the outer and inner members assembled with each other.

FIG. 5 shows the outer and the inner member 3, 4 of the present invention prior to the assembling thereof, while FIG. 6 shows the state after assembling the same.

In assembling the inner member 4 with the outer member 3, it is merely necessary to insert the forward end 4*a* of the inner member 4 in the outer member 3 through the end 3*a* thereof, after a helical resistor is loaded in the inner member 4, with the cut out portion 8 aligned with the ridge 5 and continue to move the inner member 4 until the forward end 4*a* abuts against the stopper projections 7, 7, wherein the portion of the inner member 4 contacting with the arresting claw 6 is deformed to allow further movement of the inner member 4 and the arresting claw 6 is snugly received in the arresting recess 9 at the moment the inner member 4 has just abutted and has been arrested by the stopper projections 7, 7.

Thus, the inner member 4 is prevented from moving toward the right by the stopper projections 7, 7 while the leftward movement of the inner member 4 is positively prevented by the engagement of the arresting surface 6*b* of the arresting claw 6 with the end surface of the arresting recess 9.

What is claimed is:

1. In a device for holding a helically wound wire resistor of a wire-wound potentiometer adapted to hold said resistor in a helical groove in an inner surface of a cylindrical body of said device, the improvement wherein a cylindrical body comprises: (1) an outer cylindrical member having a cylindrical inner surface with a longitudinal inwardly projecting ridge of a predetermined width extending over its entire length, said outer cylindrical member being further provided in its inner surface at a position annularly offset from said ridge and at intermediate length thereof with a projecting claw having a guide surface sloping toward one end of said outer member to merge with said inner surface as well as with at least a stopper projecting inwardly from said inner surface at a second end of said outer member and, (2) an inner member of an elastic nature having an outer cylindrical surface adapted to engage with said inner surface of said outer member and an inner surface with a helical groove formed therein for receiving and holding a helically wound wire resistor, said inner member having a longitudinal cut out portion extending over its entire length, said cut out portion having a width corresponding to the width of the ridge of said outer member to receive said ridge therein, said inner member further having an arresting recess in the outer surface thereof adapted to receive and arrest a claw of said outer member when said inner member is inserted into said outer member until a forward end of said inner member is arrested by a stopper projection portion of said inner member contacting with said claw when said inner member is moved in said outer member until said forward end thereof is arrested by said stopper projection being permitted to be deformed elastically by said claw to allow the latter to be received in said recess when said forward end is arrested by said stopper projection thereby preventing said inner member from moving in opposite directions relative to said outer member.

* * * * *